US011639639B2

(12) United States Patent
Holck et al.

(10) Patent No.: US 11,639,639 B2
(45) Date of Patent: May 2, 2023

(54) METHOD AND SYSTEM FOR MITIGATING CABLE WEAR IN A HOISTING SYSTEM

(71) Applicant: MAERSK DRILLING A/S, Kgs. Lyngby (DK)

(72) Inventors: Jesper Holck, Hellerup (DK); Kristian E. Hansen, Fredensborg (DK)

(73) Assignee: NOBLE DRILLING A/S, Kgs. Lyngby (DK)

( * ) Notice: Subject to any disclaimer, the term of this patent is extended or adjusted under 35 U.S.C. 154(b) by 196 days.

(21) Appl. No.: 16/972,569

(22) PCT Filed: Jun. 6, 2019

(86) PCT No.: PCT/DK2019/050176

§ 371 (c)(1),
(2) Date: Dec. 4, 2020

(87) PCT Pub. No.: WO2019/233539

PCT Pub. Date: Dec. 12, 2019

(65) Prior Publication Data

US 2021/0238935 A1 Aug. 5, 2021

(30) Foreign Application Priority Data

Jun. 6, 2018 (DK) ..... 2018 00262

(51) Int. Cl.
*E21B 19/09* (2006.01)
*B66C 13/02* (2006.01)
(Continued)

(52) U.S. Cl.
CPC ..... *E21B 19/09* (2013.01); *B66D 3/043* (2013.01); *E21B 19/006* (2013.01); *B66C 13/02* (2013.01)

(58) Field of Classification Search
CPC ..... B66D 3/043
(Continued)

(56) References Cited

U.S. PATENT DOCUMENTS 4,828,420 A * 5/1989 Otsuka ..... A46B 7/04 401/268
4,828,430 A * 5/1989 van der Heyden ..... E02B 17/00 405/209
6,926,260 B1 * 8/2005 De Groot ..... E21B 19/008 254/285
2002/0166698 A1 * 11/2002 Beato ..... E21B 15/02 175/85
(Continued)

FOREIGN PATENT DOCUMENTS

EP 865631 A1 * 9/1998 ..... B41C 1/1066
EP 2865631 A1 * 4/2015 ..... B66C 23/185
(Continued)

OTHER PUBLICATIONS

International Patent Application No. PCT/DK2019/050176, International Search Report and Written Opinion dated Sep. 4, 2019, 8 pgs.

*Primary Examiner* — Matthew Troutman
*Assistant Examiner* — Douglas S Wood
(74) *Attorney, Agent, or Firm* — Cozen O'Connor

(57) ABSTRACT

A method for mitigating the effects of cable wear in an active heave compensated hoisting system of an offshore vessel in a locked to bottom mode of operation is disclosed. The method comprises supporting an upper end of a string which is connected to a subsea well from a travelling block of the hoisting system, wherein the travelling block is suspended from a crown block via a cable. The method further comprises operating an active heave compensation system to control a drawworks of the hoisting system to pay in and out the cable to compensate for motion of the offshore vessel
(Continued)

and maintain a target overpull in the string. The method further comprises adjusting a ballast system of the offshore vessel to vary the draft of the vessel, and controlling the drawworks in accordance with the variation in the draft of the vessel to cause a length of cable to slip through the hoisting system and maintain the target overpull in the string.

10 Claims, 3 Drawing Sheets

(51) Int. Cl.

| | |
|---|---|
| ***E02D 5/24*** | (2006.01) |
| ***B66D 1/48*** | (2006.01) |
| ***B66D 3/04*** | (2006.01) |
| ***E21B 19/00*** | (2006.01) |

(58) Field of Classification Search
USPC ..... 254/277
See application file for complete search history.

(56) References Cited

U.S. PATENT DOCUMENTS

| | | | | |
|---|---|---|---|---|
| 2012/0025156 | A1* | 2/2012 | Roodenburg | B66D 3/08 254/337 |
| 2021/0238935 | A1* | 8/2021 | Holck | E21B 19/006 |

FOREIGN PATENT DOCUMENTS

| | | | | | |
|---|---|---|---|---|---|
| EP | 2865631 | A1 | | 4/2015 | |
| GB | 2098945 | A | * | 12/1982 | B63B 35/44 |
| WO | WO 2011/008835 | A2 | | 1/2011 | |
| WO | WO-2011008835 | A2 | * | 1/2011 | B63B 35/44 |
| WO | WO 2014/170502 | A2 | | 10/2014 | |
| WO | WO-2014170502 | A2 | * | 10/2014 | B63B 35/4413 |
| WO | WO 2015/080584 | A1 | | 6/2015 | |
| WO | WO-2015080584 | A1 | * | 6/2015 | B66C 13/04 |
| WO | WO-2018106120 | A1 | * | 6/2018 | B63B 17/00 |
| WO | WO-2019093899 | A1 | * | 5/2019 | B63B 35/4413 |
| WO | WO-2020173670 | A1 | * | 9/2020 | B63B 35/4413 |

* cited by examiner

METHOD AND SYSTEM FOR MITIGATING CABLE WEAR IN A HOISTING SYSTEM

CROSS-REFERENCE TO RELATED APPLICATIONS

This application is a 35 U.S.C. § 371 filing of International Application No. PCT/DK2019/050176 filed Jun. 6, 2019, which claims the benefit of priority to Danish Patent Application No. DK 2018 00262 filed Jun. 6, 2018, which is incorporated herein by reference in its entirety.

FIELD

The present disclosure relates to a method and system for mitigating the effects of cable wear in an offshore active heave compensated hoisting system.

BACKGROUND

Hoisting systems are used in multiple applications for handling payloads or facilitating operations on offshore vessels (platforms, rigs, ships etc.) associated with the oil and gas industry. For example, hoisting systems are used for supporting drilling operations, such as for supporting the upper end of a drill string, performing lifting operations, deployment/retrieval of subsea equipment, supporting well testing operations, well intervention operations, well abandonment operations, supporting equipment suspended from vessels such as risers, landing strings and the like.

A typical offshore hoisting system is incorporated with a derrick or mast of a vessel and includes a crown block fixed to an upper end of the derrick, and a travelling block which is suspended below the crown block via a cable or drill line, wherein a payload may be connected, directly or indirectly, to the travelling block. The cable extends from a drawworks and is reeved through one or more pulleys of the crown and travelling blocks, normally with multiple passes to provide a desired mechanical advantage, and then to a deadline anchor. The cable portion which extends from the drawworks is typically referred to as the fast line, and the cable portion which extends towards the deadline anchor is typically referred to as the deadline. The drawworks is controlled to pay in/out the cable to cause the travelling block to move as desired. The drawworks may be used to adjust the position/height of the travelling block and thus of a connected payload, and/or may be used to apply a suitable overpull or tension within a payload or equipment which may also be connected to separate infrastructure, such as seabed infrastructure.

In many offshore hoisting operations it may be desirable to compensate for vessel motions, such as might be caused by wave motion, tidal variation and the like. Such compensation may seek to maintain the travelling block and suspended payload at a desired location with respect to a reference point, such as another vessel, the seabed or the like. Heave compensation may be of particular importance in conditions referred to as locked to bottom (LTB), which relates to a payload or apparatus, such as a string of tubulars, riser, landing string, cable or the like extending from the hoisting system to a fixed subsea location, such as a seabed location. In such circumstances heave compensation may seek to maintain a desired overpull or tension in the payload or apparatus during normal vessel motions.

Passive heave compensation systems are known, which typically function to dampen movement within the hoisting system caused by heave motions. Passive heave compensators may incorporate hydraulic cylinders, gas accumulators and the like.

Active heave compensation systems are also known, which actively adjust the hoisting system to account for vessel motions. Some active heave compensation systems actively control the drawworks of the hoisting system to cyclically pay in and out the cable in accordance with vessel motions to maintain a desired position of the travelling block. In such a system the hoisting cable will move through the hoisting system in a reciprocating manner in accordance with the required degree of compensation, and thus will be exposed to a certain degree of wear and fatigue, for example by passing over the sheaves of the crown and travelling blocks. It will typically be the case that individual sections of the cable will be prone to more wear/fatigue than other sections, by virtue of these individual sections reciprocating over high stress locations within the hoisting system, such as over the block sheaves for a larger fraction of the operating time. Such cable wear and fatigue can be a major consideration in the operational life span of the cable.

Following a period of use the cable of a hoisting system will need to be replenished, which requires any load from the travelling block to be removed any thus any hoisting operations to be ceased. Cable replacement may be achieved by via a "cut and slip" operation, as disclosed in, for example, WO 2016/024866, which involves reeling fresh cable through the hoisting system from a storage drum on the deadline side while at the same time reeling the worn cable onto the drawworks, cutting the cable on the fast line side, disposing of the worn cable on the drawworks, and connecting the fresh cable to the drawworks.

Some hoisting operations may be of a sufficiently short duration such that cable replacement can be accommodated in between such operations. However, this might not be possible in longer term operations where it may be necessary to entirely cease operations to permit replenishment of the cable. This might be the case during operations such as well testing, workover and the like, which might, for example require a number of days. The requirement to cease operations to replace cable may result in delays, may compromise the effectiveness of the operation, and in some cases may increase costs.

U.S. Pat. No. 6,926,260 discloses hoist system connected to a floating vessel that minimizes the energy consumption and operating cost of lifting operations. The hoisting system for a vessel has a base structure provided with fixed cable blocks with pulleys. The hoisting device comprises a trolley connected to the cable pulley block and a mechanism for gripping a load. The hoisting device comprises a hoisting mechanism with a hoisting cable and winch and first and second compensators.

SUMMARY

Aspects of the present disclosure relate to methods and systems for mitigating the effects of cable wear in a heave compensated hoisting system of an offshore vessel. Disclosed methods and systems may permit cable to slip through the hoisting system to accommodate for wear and/or cable fatigue, for example to reposition any worn or fatigued cable portions to a more favourable position within the hoisting system, such as away from high stress locations including sheaves and the like. Such cable slipping may be achieved without requiring a hoisting operation to be interrupted, for example without requiring disconnection from a payload. Cable slipping may be facilitated by adjusting a ballast system of an offshore vessel while controlling a drawworks of the hoisting system to cause a predetermined length of cable to move or slip through the hoisting system.

An aspect of the present disclosure relates to a method for mitigating the effects of cable wear in an active heave compensated hoisting system of an offshore vessel in a locked to bottom mode of operation, the method comprising:

connecting an upper end of a string which is connected to a subsea well to a travelling block of the hoisting system, wherein the travelling block is suspended from a crown block via a cable;

applying a target overpull in the string through the travelling block;

operating an active heave compensation system to control a drawworks of the hoisting system to pay in and out the cable to compensate for motion of the offshore vessel and maintain the target overpull in the string;

adjusting a ballast system of the offshore vessel to vary the draft of the vessel; and controlling the drawworks in accordance with the variation in the draft of the vessel to cause a length of cable to slip through the hoisting system and maintain the target overpull in the string.

The cable may be affected by wear and/or fatigue during active heave compensation, for example by reciprocating movement of discrete sections of the cable over high stress regions, such as over the crown and travelling blocks. Adjusting the ballast system and varying the draft of the vessel will cause a length of the cable to be moved or slipped through the hoisting system, which may shift and realign portions of the cable relative to the hoisting system. The length of cable slipped through the system may be sufficient to reposition those cable sections which might have been subject to the greatest stress, wear and/or fatigue. Thus, adjusting the ballast system may represent a deliberate step taken to initiate a degree of cable slippage and "replenishment", and mitigate the effects of cable wear.

Cable wear may include any physical or mechanical weakening or degradation.

The cable may slip through the hoisting system by virtue of seeking to maintain the target overpull in the string. That is, adjusting the ballast system and varying the draft of the vessel may in normal circumstances cause the location or position of the travelling block to adjust with the vessel, and thus cause a variation in load applied within the string through the travelling block. Such adjustment of the travelling block in the present disclosure, however, is counteracted by controlling the drawworks and slipping a length of the cable through the hoisting system.

Maintaining the target overpull in the string during adjustment of the ballast system to facilitate slipping of the cable may permit the hoisting system to continue its use in supporting the string and any associated operations. That is, cable slippage may be permitted without interrupting any hoisting operations in progress. This may provide operational and cost benefits, for example by permitting continuous operations to be achievable while still accounting for safety requirements. This may provide advantages in operations such as downhole operations, well testing, running/pulling completions, workover, intervention, plug and abandon operations, and the like, which may require a number of days to complete. Furthermore, cable slip may be achieved with minimal personnel intervention, improving safety.

Thus, the method may comprise adjusting the ballast system to cause a length of cable to slip through the hoisting system without disconnecting the string relative to the travelling block.

The vessel may comprise any suitable floating vessel, such as a drilling vessel, workover vessel, or the like. In some examples the cable may be defined as a drill-line. Thus, the term "cable" may be interchangeable with "drill-line".

The locked to bottom mode of operation of the vessel may be provided by virtue of the string being connected between the travelling block and the subsea well. Such connection of the string with the subsea well may comprise a fixed connection, such as a rigid connection. The connection of the string to the subsea well may be achieved at a BOP (e.g., with pipe rams closed around the string), at a wellhead, at a downhole location, and/or the like.

The target overpull in the string may seek to achieve a desired axial load profile in the string when in the locked to bottom mode of operation. An overpull condition in the string may be desired for a number of reasons, such as to at least partially support the weight of the string, improve the stability of the string, avoid undesired loading conditions such as exceeding a critical buckling load, and the like. Seeking to maintain the target overpull in the string may permit the overpull condition to be achieved, while minimising the risk of overloading the string, for example causing tensile overloading during vessel motions.

The target overpull may comprise a substantially constant overpull. The target overpull may comprise applying a substantially constant target load through the travelling block connected to the upper end of the string. Such a load applied through the travelling block may be defined as a hook load. The substantially constant target load may comprise a degree of tolerance, for example within 1 to 25% of the target load, within 5 to 20% of the target load, such as around 8 to 15% of the target load.

The travelling block may be directly connected to the string. Alternatively, the travelling block may be indirectly connected to the string, for example via a top drive, lifting frame, tension frame, and/or the like. In some examples the level of overpull applied may be determined at the travelling block, and/or at any intervening equipment between the travelling block and the string.

The crown and travelling blocks may comprise one or move sheaves, wherein the cable is reeved through the one or more sheaves. The crown and travelling blocks may each comprise multiple sheaves such that the cable passes multiple times between the crown and travelling blocks. The provision of multiple sheaves and corresponding passes of the cable between the crown and travelling blocks may provide a lifting mechanical advantage, such that the payload may be greater than the load applied by the drawworks. The multiple sheaves may provide multiple high stress or wear points along the cable.

A result of the mechanical advantage provided by the multiple sheaves and cable passes is that the cable must move at a far greater rate than the travelling block. This factor may provide advantages in the present disclosure in that a larger length of cable will be required to slip through the hoisting system than the variation in vessel draft in order to permit the target overpull in the connected string to be maintained. This may allow a smaller adjustment of the ballast system and variation in vessel draft to provide the required length of cable slippage through the hoisting system to accommodate for cable wear. In some examples the draft of the vessel may only need to be varied by 1 m to require a 16 m movement of the cable through the hoisting system to permit the target overpull in the connected string to be maintained. That is, the cable may need to slip 16 m to cause the travelling block to move 1 m to accommodate for the variation in the draft of the vessel by the ballast adjustment.

The method may comprise determining a requirement to slip the cable through the heave compensated hoisting system prior to adjusting the ballast system. This determination may be based on operator experience. Alternatively, or additionally, this determination may be based on data associated with the hoisting system, such as cable condition, historic use of the hoisting system, operation time, ton-miles utilisation of the cable, cable movement, usage of active heave compensation (e.g., average length of cable movement during heave compensation), loading applied, relative movement between the travelling block and the crown block, and the like.

The method may comprise determining a condition of the cable and adjusting the ballast of the vessel in accordance with the determined cable condition. The method may comprise determining the condition of the cable based on measured or sensed parameters, such as applied load, elongation, strain, physical inspection and the like. The method may comprise determining the condition of the cable analytically, for example via numerical analysis, modelling, computational simulation and the like. Such analytical determinations may utilise physical parameters, such as historic use, loading, cable travel, relative movement between the travelling block and the crown block, historic use of the heave compensation system (e.g., average length of cable movement during heave compensation), ton-miles utilisation of the cable, geometry of the hoisting system and the like.

The length of cable slipped through the hoisting system in response to adjusting the ballast system may be a predetermined length. "Predetermined" in this respect should be understood to be a length determined in advance. The predetermined length may be sufficient to reposition those cable sections which might have been subject to the greatest stress, wear and/or fatigue.

The method may comprise determining a required length (i.e., the predetermined length) of cable to be slipped through the hosting system, for example to accommodate for wear and/or fatigue in the cable. The method may comprise determining a required adjustment of the ballast system in accordance with the predetermined length of cable to be slipped through the hoisting system.

The method of determining the required length of the cable may be based upon operator experience. The method of determining the required length of cable may be based on analytical methods or techniques, such as computational techniques. The method of determining the required length of cable may be based on historic use of the hosting system. For example, the method may comprise determining the required length of cable to be slipped through the hoisting system based on data associated with the use of the hoisting system, such as operation time, ton-miles utilisation of the cable, cable movement during heave compensation, loading applied, relative movement between the travelling block and the crown block, and the like.

The method may comprise operating the heave compensation system to compensate for motion of the offshore vessel during the step of adjusting the ballast system of the offshore vessel. In this respect, vessel motions may still be accommodated for during the process cable slipping. Such vessel motions may be caused by wave motion, tidal variations and the like.

The method may comprise using the active heave compensation system to control the drawworks in accordance with the variation in the draft of the vessel to cause a length of cable to slip through the hoisting system. In this respect an existing active heave compensation system may be utilised to permit cable slippage to be achieved, which may minimise the requirement for additional systems to perform this function. In some examples the active heave compensation system may be configured to maintain its normal operation and function during adjustment of the ballast system. In this respect, the active heave compensation system may rely on normal input parameters, such as sensed input parameters, to determine the requirement to control the drawworks to accommodate the variation in the draft of the vessel. A number of input parameters may be utilised which are associated with the locked to bottom mode of operation, for example a load parameter on the travelling block (e.g., hook load).

The target overpull in the string may be achieved with the travelling block located in a position or position range. The position of the travelling block may comprise a position or range of positions which is substantially fixed relative to the seabed. In some examples input parameters used to control the drawworks to seek to maintain the overpull condition in the string during adjustment of the ballast system may comprise a position or position range of the travelling block. However, in some examples such position control of the travelling block may be a secondary requirement, or indeed a consequence of, seeking to maintain the overpull condition in the string. That is, the position of the travelling block will follow from the target or constant overpull setting.

As noted above, the active heave compensation system is operated to control the drawworks to seek to maintain the target overpull condition in the string, to counter the effect of vessel motions such as might be caused by wave motion, tidal variations and the like. During this active heave compensation the distance between the travelling block and crown block may vary.

The string may comprise equipment associated with the formation of a well. The payload may comprise equipment associated with well testing, such as flow testing. The string may comprise a riser, landing string, string of connected tubulars, coiled tubing, and the like.

The draft of the vessel should be understood to be related to the position of the waterline with respect to the vessel, for example the hull of the vessel.

The method may comprise de-ballasting the vessel (i.e., raise the vessel). This may result in the drawworks being controlled to pay out the cable to seek to maintain the target overpull in the string.

The method may comprise ballasting the vessel (i.e., lower the vessel). This may result in the drawworks being controlled to pay in the cable to seek to maintain the target overpull in the string. In this example worn, fatigued or stressed cable may be moved towards and in some examples at least partially onto a drawworks drum, depending on the variation in vessel draft.

The method may comprise providing a single adjustment of the ballast system. In this respect a single cable slipping operation may be performed, for example in response to a determination that a slippage operation is required.

The method may comprise multiple adjustments of the ballast system. For example, multiple discrete adjustments of the ballast system may be performed, to thus provide cable slippage in stages.

The method may comprise a continuous or gradual adjustment of the ballast system, which may provide a continuous slippage of the cable.

In some examples multiple or gradual/continuous adjustment of the ballast system may in some examples prolong the longevity of the cable.

The cable may comprise a metal cable. However, other types of cable may be used within the hoisting system, such as synthetic cables, composite cables and the like.

The method may comprise performing offshore operations associated with the subsea well prior to the vessel entering the locked to bottom mode. Such operations may comprise drilling operations and the like. Such operations may utilise the active heave compensated hoisting system of the offshore vessel. In some examples the hoisting system may be utilised with or without use of the active heave compensation system.

Prior use of the hoisting system (i.e., prior to the locked to bottom mode of operation) may create a degree of initial cable wear. The method may comprise slipping the cable through the hoisting system to mitigate the effects such initial cable wear. For example, the method may comprise positioning substantially unstrained wire at one or more stressing points of the hoisting system (e.g., proximate to a drawworks drum, at the sheaves etc.).

The method may comprise slipping or replenishing the cable from a storage drum, for example located on a deadline side of the hoisting system.

The method may comprise performing a slip and cut operation. The method may comprise slipping a length of cable through the hoisting system and cutting the cable so that a major part of the active (i.e. not solely at the drawworks drum during operation) is fresh, such as more than 30% or more, such as 40% or more, such as 50% or more, such as 60% or more, such as 70% or more, such as 80% or more, such as 90% such as substantially all the active wire. This may be advantageous in providing substantially replenished cable through the hoisting system for use during the locked to bottom mode of operation. This may be further advantageous in that the locked to bottom mode of operation is initiated with fresh cable at the stressing point(s) providing a well-known starting point for any subsequent calculations and determinations of cable wear which might dictate the requirement to initiate adjustment of the ballast system of the vessel.

An aspect of the present disclosure relates to an offshore vessel mounted hoisting system, comprising:

- a crown block and a travelling block suspended from the travelling block via a cable, wherein the travelling block is connectable to a string which is connected to a subsea well such that the travelling block can apply an overpull in the string;
- a drawworks for controlling movement of the cable and the travelling block;
- an active heave compensation system for controlling the drawworks to pay in and out the cable to compensate for motion of the offshore vessel and maintain a target overpull in a connected string; and
- a cable replenishment system comprising a controller for adjusting a ballast system of the offshore vessel to vary the draft of the vessel and to control the drawworks to cause a length of cable to slip through the hoisting system and maintain the target overpull in the connected string.

The offshore vessel mounted hoisting system may incorporate features defined in relation to any other aspect.

An aspect of the present disclosure relates to a method for performing hoisting operations on an offshore vessel in a locked to bottom mode of operation, the method comprising:

- connecting an upper end of string which is connected to a subsea well from a travelling block of an active heave compensated hoisting system, wherein the travelling block is suspended from a crown block via a cable;
- applying a target overpull in the string through the travelling block;
- operating an active heave compensation system to control a drawworks of the hoisting system to pay in and out the cable to compensate for motion of the offshore vessel and maintain the target overpull in the string;
- slipping cable within the hoisting system by adjusting a ballast system of the offshore vessel to vary the draft of the vessel and controlling the drawworks in accordance with the variation in the draft of the vessel to cause a length of cable to slip through the hoisting system.

The method according to the present aspect may incorporate features defined in relation to any other aspect.

An aspect of the present disclosure relates to a system for mitigating the effects of cable wear in an offshore active heave compensated hoisting system which includes a crown block and a travelling block suspended from the travelling block via a cable controlled by a drawworks, the system comprising:

- a controller configured to adjust a ballast system of an offshore vessel upon which the hoisting system is mounted to vary the draft of the vessel and to control the drawworks to cause a length of cable to slip through the hoisting system and maintain a target overpull in a string connected to the travelling block.

The system according to the present aspect may incorporate features defined in relation to any other aspect.

An aspect of the present disclosure relates to a method for slipping cable in a hoisting system of an offshore vessel to accommodate cable wear, the method comprising:

- adjusting a ballast system of the offshore vessel to vary the draft of the vessel; and
- controlling a drawworks of the hoisting system in accordance with the variation in the draft of the vessel to cause a predetermined length of cable to slip through the hoisting system.

The method according to the present aspect may incorporate features defined in relation to any other aspect.

BRIEF DESCRIPTION OF THE DRAWINGS

These and other aspects of the present disclosure will now be described by way of example only with reference to the accompanying drawings, in which.

DETAILED DESCRIPTION OF THE DRAWINGS

Figure 1:
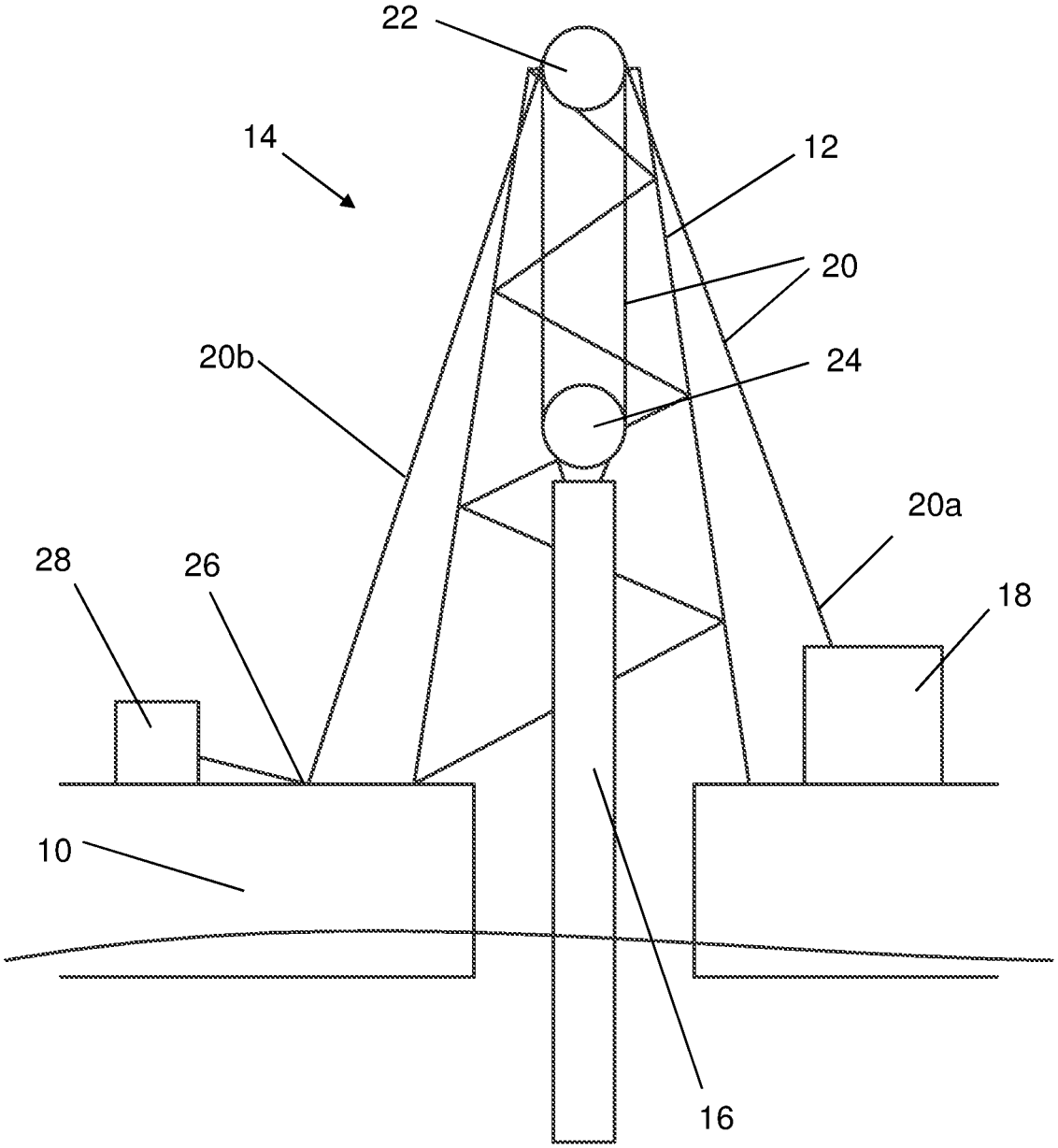
FIG. 1 is a diagrammatic illustration of a hoisting system provided on an offshore vessel.

FIG. 1 diagrammatically illustrates a portion of an offshore vessel 10 which includes a derrick 12 and a hoisting system, generally identified by reference numeral 14, which might typically be used to support operations associated with the offshore oil and gas industry, for example to provide support to a payload 16. For exemplary purposes the vessel 10 may be a drilling vessel (e.g., a drill ship). The hoisting system 14 includes a drawworks 18 (or a winch) for controlling a hoisting cable (or drill-line) 20, a crown block 22 and a travelling block 24 suspended from the crown block 22 via the cable 20, wherein the travelling block 24 can be connected to the payload 16. A portion of the hoisting cable 20 extends between the drawworks 18 and the crown block 22 and is typically referred to as the fast line 20*a*. A portion of the hoisting cable 20 extends from the crown block 22 to a fixed anchor 26 and is typically referred to as the deadline 20*b*. The cable 20 may terminate at the anchor 26, or as in the illustrated example may optionally also extend to a deadline cable storage drum 28.

The drawworks 18 is controlled to pay in/out the cable to adjust the height of the travelling block 24. Further, the cable 20 may pass a number of times between sheaves (not individually shown) of the crown and travelling blocks 22, 24 to provide a desired lifting mechanical advantage.

The hoisting system 14 in the present example is an active heave compensated hoisting system, specifically an active heave compensated drawworks hoisting system, in which the drawworks 18 is controlled to pay in and out the cable 20 in accordance with vessel motions, such as caused by wave motion, tidal variation and the like.

During operation of the hoisting system 14 it may be necessary to mitigate the effects of wear on the cable 20, for example due to wear and/or cable fatigue such as caused by the cable running over the sheaves of the crown and travelling blocks 22, 24. An example method for mitigating the effects of wear on the cable will now be described with reference to FIGS. 2 and 3, which illustrate a specific example of the vessel 10 in a locked to bottom mode of operation. However, prior to the vessel 10 entering a locked to bottom mode of operation a slip-and-cut operation may be performed to replenish the cable 20 within the hoisting system 14, such that a fresh portion of cable 20, at least relative to the stress points in the hoisting system 14, is provided prior to initiating the locked to bottom mode of operation.

Figure 2:
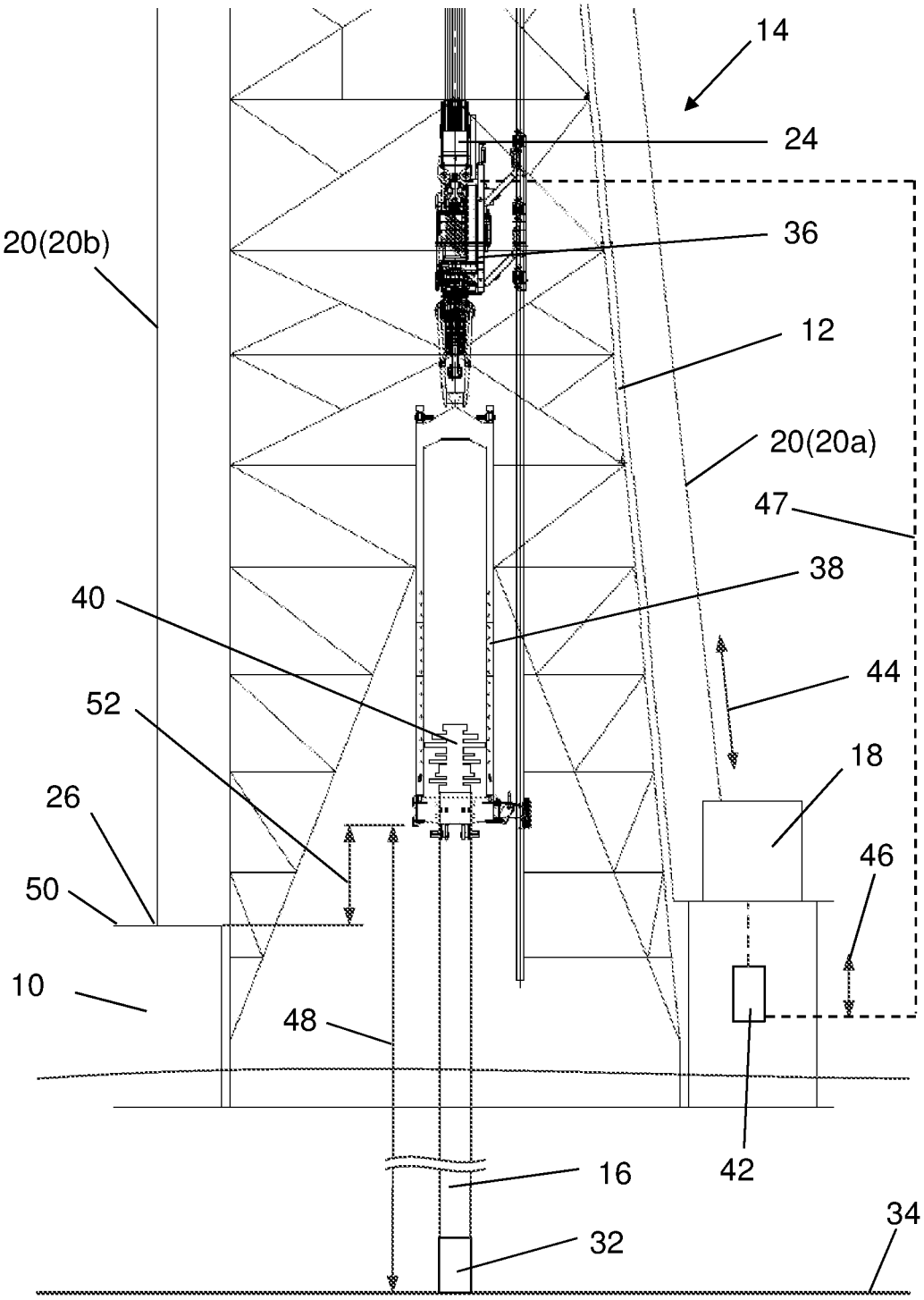
FIGS. 2 and 3 illustrate a sequence of replenishing a length of cable in an offshore hoisting system.

Referring initially to FIG. 2, the hoisting system 14 of FIG. 1 is again illustrated, omitting the top end of the derrick 12 and thus the crown block 22 (FIG. 1). Furthermore, in this case the cable storage drum 28 (FIG. 1) has been omitted as being optional. The hoisting system 12 in the present example is illustrated in use supporting a tubular string 16 (e.g., a riser) which is secured at its lower end to a subsea wellhead 32 at the seabed 34. The upper end of the tubular string 16 is supported by the travelling block 24 via a topdrive 36 and a tension frame 38. As such, the tubular string 16 is connected between the wellhead 32 and the travelling block 24, thus establishing the locked to bottom mode. The hoisting system 14 is controlled to apply a desired or target substantially constant overpull in the tubular string 16.

A well control tree 40 is mounted within the tension frame 38 and is secured to the top end of the tubular string 16. In the present example the hoisting system 14 supports the various components and equipment during a well testing operation (or any other well operation), which might require a number of days to complete. The present disclosure provides methods and systems which can mitigate or account for cable wear within the hoisting system 14 without interrupting such operations.

In the present example an active heave compensation system 42 is provided which controls the drawworks 18 in accordance with known principles to pay in and out the cable 20, illustrated by double-headed arrow 44, to compensate for motion of the offshore vessel 10, illustrated by double-headed arrow 46. Such compensation may be performed to maintain the target overpull condition within the tubular string 16. The active heave compensation system 42 may utilise a number of input parameters for suitable operation, such as the "hook load" at the travelling block 24, illustrated by broken line 47. In some examples maintaining the target overpull condition within the tubular string 16 may be such that the travelling block 24 and tension frame 38 are maintained at a substantially fixed position, for example at a fixed height 48 relative to the seabed 34. Such adjustment of the drawworks 18 may result in the position of the tension frame 38 varying relative to a deck surface 50 of the vessel 10, as illustrated by double-headed arrow 52. The cyclical and reciprocating movement of the cable 20 through the hoisting system 14 may accelerate wear and/or fatigue within the cable 20.

During use an operator may undertake suitable monitoring and analysis to determine a requirement to address cable wear. This determination may be based on operator experience, and/or on data associated with the hoisting system 14, such as historic use of the hoisting system 14, operation time, ton-miles utilisation of the cable 20, cable movement, usage of the heave compensation system 42, loading applied, and the like. The condition of the cable 20 may be monitored and/or determined, for example based on measured or sensed parameters, such as applied load, elongation, strain, physical inspection and the like. Alternatively, or additionally, the condition of the cable 20 may be determined analytically, for example via software tools, numerical analysis, modelling, computational simulation and the like. Such analytical determinations may utilise physical parameters, such as is historic use, loading, cable travel, relative movement between the travelling block 24 and the crown block 22 (FIG. 1), historic use of the heave compensation system 42, ton-miles utilisation of the cable 20, geometry of the hoisting system 14 and the like.

Figure 3:
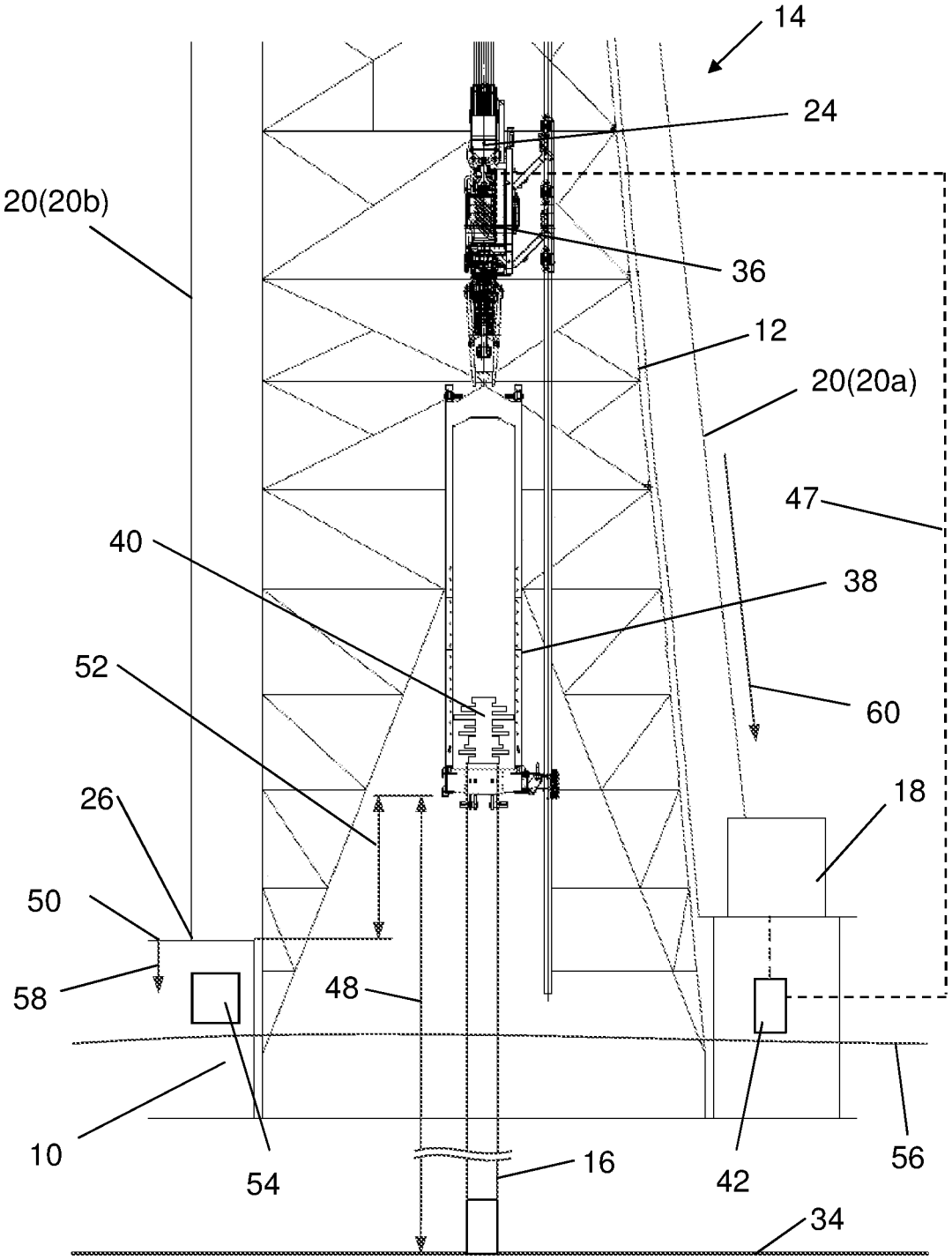

With reference now to FIG. 3, when it is determined that cable wear needs to be addressed a ballast system 54 of the vessel 10 is deliberately adjusted to vary the draft of the vessel 10. In the specific example of FIG. 3 the ballast system 54 is adjusted to lower the vessel 10 relative to the waterline 56, illustrated by arrow 58. The lowering of the vessel 10 will thus seek to also lower the height of the travelling block 24 and tension frame 38 relative to the seabed 34, and thus cause a variation in the applied overpull in the tubular string 16. However, the active heave compensation system 42 reacts to the lowering of the vessel to control the drawworks 18 (for example in response to one or more input/sensed parameters, such as hook load 47) and pay in a necessary length of cable 20, illustrated by arrow 60, to adjust the relative position of the travelling block 24 (e.g., relative to the seabed 34, deck 50, crown block 22 (FIG. 1) etc.) to maintain the target overpull condition in the tubular string 16. The adjustment of the hoisting system 14 may thus increase the distance 52 between the tension frame 38 and deck surface 50.

Such control of the drawworks 18 in response to adjusting the ballast system 54 thus causes a length of cable 20 to slip through the hoisting system 14 to reposition any worn, stressed or fatigued cable portions to a more favourable position, such as away from the sheaves of the travelling block 24 and crown block 22 (FIG. 1). The length of cable 20 slipped through the hoisting system 14 in response to adjusting the ballast system 54 may be determined in advance to be sufficient to reposition those cable sections which might have been subject to the greatest wear and/or fatigue. This advance determination may be based upon operator experience, sensed parameters, analytical techniques, and the like. This predetermined cable adjustment may then inform the required adjustment of the ballast system 54.

In the present example the travelling block 24 and crown block 22 (FIG. 1) each includes multiple sheaves to provide a number of cable passes and thus a desired lifting mechanical advantage. However, this also requires that the cable 20 must move at a far greater rate than the travelling block 24. This factor may provide advantages in the present disclosure in that a larger length of cable 20 will be required to slip through the hoisting system 14 than the variation in the draft of the vessel 10 in order to maintain the target overpull in the tubular string 16. This may allow a smaller adjustment of the ballast system 54 and variation in vessel draft to provide the required length of cable slippage through the hoisting system 14 to accommodate for cable wear/fatigue. In some examples the draft of the vessel 10 may only need to be varied by 1 m to require a 16 m slippage of the cable 20 through the hoisting system 14 to maintain the target overpull in the tubular string 16.

In the example presented above the ballast system 54 is adjusted to lower the vessel 10 within the water. However, a similar cable slippage effect may be achieved by raising the vessel 10 in the water, causing the drawworks 18 to pay out cable 20. Furthermore, while the present example utilises the heave compensation system 42 to react to the adjustment of the ballast system 54, a separate dedicated system may also be provided.

The example presented above illustrates a single adjustment of the ballast system 54. However, the process may be repeated as required, and as permitted by the draft of the vessel 10. Further, the disclosed method may adjust the ballast system 54 in a series of discrete stages, such that a number of cable replenishment operations are provided. Further still, the ballast system 54 may be adjusted continuously, to continuously and gradually slip the cable 20 within the hoisting system 14.

In the example presented an active heave compensation system 42 is provided. However, in other examples a passive heave compensation system may also be provided, for example interposed between the topdrive 36 and tension frame 38, incorporated within the tension frame 38, and/or the like.

The example described above exemplifies a benefit of the methods and systems in mitigating the effects of cable wear without interrupting operations. However, once the operations (e.g., flow testing) are completed a more conventional cable replenishment operation may take place, such as a cut-and-slip operation.

The invention claimed is:

1. A method for mitigating the effects of cable wear in an active heave compensated hoisting system of an offshore vessel in a locked to bottom mode of operation, the method comprising:

connecting an upper end of a string which is connected to a subsea well to a travelling block of the hoisting system, wherein the travelling block is suspended from a crown block via a cable;

applying a target overpull in the string;

operating an active heave compensation system to control a drawworks of the hoisting system to pay in and out the cable to compensate for motion of the offshore vessel and maintain the target overpull in the string;

adjusting a ballast system of the offshore vessel to vary the draft of the vessel while operating the heave compensation system to compensate for motion of the offshore vessel; and controlling the drawworks in accordance with the variation in the draft of the vessel to cause a length of cable to slip through the hoisting system and maintain the target overpull in the string.

2. The method according to claim 1, comprising adjusting the ballast to cause a length of cable to move through the hoisting system without disconnecting the string from the travelling block.

3. The method according to claim 1, comprising determining a requirement to slip the cable through the heave compensated hoisting system prior to adjusting the ballast system.

4. The method according to claim 3, comprising determining a condition of the cable and adjusting the ballast system of the vessel in accordance with the determined cable condition.

5. The method according to claim 4, comprising determining the condition of the cable based on measured parameters including at least one of applied load, elongation, strain and physical inspection.

6. The method according to claim 4, comprising determining the condition of the cable analytically including at least one of software tools, numerical analysis, modelling and computational simulation;

wherein the analytical determination includes using physical parameters including at least one of historic use, loading, cable travel, relative movement between the travelling block and the crown block, historic use of the heave compensation system, ton-miles utilization of the cable, and geometry of the hoisting system.

7. The method according to claim 6, comprising determining a required adjustment of the ballast system in accordance with the predetermined length of cable to be slipped through the hoisting system.

8. The method according to claim 1, comprising performing offshore operations associated with the subsea well prior to the vessel entering the locked to bottom mode.

9. The method according to claim 1, comprising slipping the cable through the hoisting system prior to the vessel entering the locked to bottom mode to replenish the cable within the hoisting system.

10. The method according to claim 1, comprising performing a slip-and-cut operation prior to the vessel entering the locked to bottom mode.

* * * * *